US006721429B1

(12) United States Patent
Akamatsu et al.

(10) Patent No.: US 6,721,429 B1
(45) Date of Patent: Apr. 13, 2004

(54) ELECTRO-MAGNETIC MICROPHONE

(75) Inventors: Norio Akamatsu, Tsune Mishima Jutsku, 2-9-2 Nakatsune Mishima, Tokushima-shi, Tokushima-ken (JP); Kaoru Tada, Takamatsu (JP)

(73) Assignees: AOI Electronics Co., LTD, Kagawa-Ken (JP); Norio Akamatsu, Tokushima-Ken (JP)

( * ) Notice: Subject to any disclaimer, the term of this patent is extended or adjusted under 35 U.S.C. 154(b) by 716 days.

(21) Appl. No.: 09/606,009

(22) Filed: Jun. 29, 2000

(30) Foreign Application Priority Data

Jul. 1, 1999 (JP) ..... 11-187457

(51) Int. Cl.[7] ..... H04R 25/00

(52) U.S. Cl. ..... 381/122; 381/111; 381/115; 398/132; 398/133

(58) Field of Search ..... 381/111–115, 122, 381/172; 398/132–133

(56) References Cited

U.S. PATENT DOCUMENTS 5,621,806 A * 4/1997 Page et al. ..... 381/172
6,014,239 A * 1/2000 Veligdan ..... 398/134
6,125,189 A * 9/2000 Yasuno et al. ..... 381/111
6,226,386 B1 * 5/2001 Akino ..... 381/173
6,449,370 B1 * 9/2002 Yasuno et al. ..... 381/71.6

FOREIGN PATENT DOCUMENTS

JP 60089783 A * 5/1985 ..... G01S/15/06
JP 61181923 A * 8/1986 ..... G01K/0/32

* cited by examiner

*Primary Examiner*—Minsun Oh Harvey
*Assistant Examiner*—Laura A. Grier
(74) *Attorney, Agent, or Firm*—Westerman, Hattori, Daniels & Adrian, LLP

(57) ABSTRACT

A microphone is provided with a simple structure by which a lead wire is not required to detect displacement of a vibrated film. The microphone is equipped with a vibrated film 2 to receive sonic waves on either surface and to receive electro-magnetic waves on other surface, a device 4 to receive and transmit the electro-magnetic waves reflected by the vibrated film, a counter to count pulses from the device to receive and transmit electro-magnetic waves, a processing logic 5 to count the pulses output from the counter. Displacement of the vibrated film is converted into electric signals by counting the processing logic the frequency and amplitude of the electro-magnetic waves reflected by the vibrated film 2.

10 Claims, 13 Drawing Sheets

ELECTRO-MAGNETIC MICROPHONE

BACKGROUND OF THE INVENTION

The present invention relates to a microphone.

Prior Art Technology

In the prior arts, a microphone is known which detects electro dynamically or electro statically displacement of a vibrated film vibrating upon sonic wave to transform electric signals, or which detects optically the displacement of the vibrated film by a laser beam.

Microphones by which the displacement of the vibrated film is detected optically by a laser beam have been proposed in U.S. Pat. Nos. 6,014,239 and 4,479,265 wherein a laser beam is radiated to the vibrated film and the reflected beam is measured by the optic detector to convert the same into electric signals.

Problems to be Solved by the Invention

A microphone for which a semi-conductor laser is used has an advantage to detect displacement by a leadless wire, while it requires a fine adjustment means to adjust finely distance between the semi-conductor laser and vibrated film and a lot of optical factors are required, which brings a complicated structure. Further, since attached things on a surface of a vibrated film cause to change characteristics of reflection of light, characteristics of the microphone are deteriorated. And especially it may impossible to receive and transmit the light in case of high humidity, and thereby the microphone ceases to function. Further, it is impossible to measure directly the frequency or phase only by an integrated logic circuit because the laser beam is light.

Measurement of the frequency of a laser beam is conducted by the method to measure difference of an optical path on the principle of constancy of light velocity by deriving the wavelength. However, this method of measurement has lower precision and requires a measuring device in larger scale. Moreover, the measurement of the optical path is not easy. Accordingly, it is difficult to provide a microphone for stable use during a long period of time if a laser beam is used.

The present invention provides a microphone with a simple structure which solves the problems mentioned above, said microphone not requiring a lead wire to detect the displacement of a vibrated film.

Means to Solve the Problems

The microphone according to the present invention is equipped with a vibrated film which vibrates upon receipt of a sonic wave and reflects an electromagnetic wave with frequency less than $10^{12}$ Hz, a device to receive and transmit the electromagnetic wave which radiates to the vibrated film and receives the electromagnetic wave reflected by the vibrated film, and a device to measure vibrated film signals which measures signals of the electromagnetic wave received by the device to receive and transmit electromagnetic wave. Measurement of the frequency and amplitude of the electromagnetic wave reflected by the vibrated film enables to change the displacement of the vibrated film to electric signals.

EXAMPLES OF THE PRESENT INVENTION

Now referring to a block diagram as shown in FIG. 1, a basic structure of the microphone according to the present invention is described. As shown in FIG. 1, the microphone 1 of the present invention is equipped with a vibrated film 2 to vibrate upon sonic wave 3 and to reflect an electromagnetic wave with frequency less than $10^{12}$ Hz, but preferably $10^8$ to $10^{10}$ Hz.

For the vibrated film 2, such a vibrated film is used as comprises of a conductive material with resistance ratio less than $20\times10^{-6}\{\Omega\ \text{cm}\}$ at 0° C. or a conductive material with the resistance ratio less than $20\times10^{-6}\{\Omega\ \text{cm}\}$ at 0° C. which is attached to an insulating film.

More specifically, a conductive film, such as aluminum or gold, or a vibrated film to which said conductive film is attached is preferably used.

Further, an antenna 6 is provided on the device to receive and transmit electro-magnetic wave 4 of the microphone 1. Electro-magnetic wave is radiated toward the vibrated film 2 from the antenna 6, and the electro-magnetic wave reflected by the vibrated film 2 is received by the antenna 6. The electro-magnetic wave received by the antenna 6 is output to the processing logic 5 from the device to receive and transmit electro-magnetic wave 4. Displacement of the vibrated film is changed to electric signals by measuring the frequency and amplitude of the electro-magnetic wave by the processing logic 5. Then, the vibrated film 2 is placed 0.1 to 0.5 mm or so close to the antenna 6 of the device to receive and transmit electromagnetic wave 4.

In the microphone 1 with the said construction, the said vibrated film vibrates by air vibration, such as a sonic wave 3. When the electro-magnetic wave generated by the said device to receive and transmit electro-magnetic wave 4 is radiated to the said vibrated film and a reflected wave from the vibrated film 2 is received, the frequency and amplitude of the electro-magnetic wave generated by the said device to receive and transmit electro-magnetic wave 4 varies corresponding to the displacement of the vibrated film 2.

Namely, if the vibrated film 2 is displaced, distance x changes between the vibrated film 2 and the antenna 6. In response to the change of the distance x, the frequency and amplitude of the signals generated by the device to receive and transmit electro-magnetic wave 4 are changed. The situation is shown in FIGS. 3 and 4. FIG. 3 shows x-f characteristics representing the relationship of the distance x between the vibrated film 2 and the antenna 6 with frequency f of the signals generated by the device to receive and transmit electro-magnetic wave 4. Here, x is the distance between the vibrated film 2 and the antenna 6. f is frequency of signals generated by device to receive and transmit electro-magnetic wave 4. As shown in FIG. 3, this frequency is higher when the distance x is shorter, and lower when it is longer. As shown in FIG. 4, said amplitude voltage is smaller when the distance x is shorter, and larger when it is longer. When the vibrated film 2 is vibrated by the sonic wave, the distance x between the vibrated film 2 and the antenna 6 varies, and the change of the distance x responds to the change of the frequency of signals generated by device to receive and transmit electromagnetic wave 4 and the amplitude voltage. Therefore, it is apparent from FIGS. 3 and 4 that it is possible to detect the vibration of the vibrated film 2 as the change of frequency of signals generated by device to receive and transmit electro-magnetic wave 4 or the amplitude voltage.

Now, as shown in FIG. 1, each of the constituent factors in the block diagram of the construction is described in its order.

Firstly, the said device to receive and transmit electro-magnetic wave 4 is explained in more detail. As shown in FIG. 2, the device to receive and transmit electro-magnetic wave 4 is equipped with a CMOS amplifier 9, said amplifier 9 comprising of a P channel MOSFET 7 and a N channel MOSFET 8, and said inductor 10 being connected between input and output terminals of the said CMOS amplifier. Said flat inductor 10 forms a positive feedback loop and forms an oscillator 11 as a whole. The flat inductor 10 functions as an antenna to transmit and receive the electro-magnetic wave. The flat inductor will be described later.

When the said oscillator 11 is in a stable condition and oscillated frequency is higher, electro-magnetic energy is injected from the said flat inductor 10 to a space close to the said flat inductor 10, and the electro-magnetic wave is radiated to the said vibrated film (FIG. 1). When the vibrated film reflects electro-magnetic wave and the flat inductor 10 receives it, the vibrated film and the flat inductor 10 are connected electro-magnetically. That is, if the distance x between the vibrated film 2 and the flat inductor 10 is changed, inductor and capacitance of the flat inductor change equivalently. On the other hand, since the flat inductor 10 forms a positive feedback loop and constructs oscillator 11 as a whole, oscillated frequency and amplitude voltage of the oscillator 11 is affected by the inductor and capacitance of the flat inductor 10. Accordingly, the oscillated frequency and amplitude voltage of the oscillator 11 are measured by processing logic 5 (FIG. 1), whereby it is possible to realize the microphone device 1 upon conversion of displacement of the vibrated film 2 into electric signals.

Now, operation is explained where displacement of the vibrated film 2 is converted into electric signals by the oscillator 11.

Gate G of CMOS amplifier 9 constituting the oscillator 11 is connected electrostatically by the existence of electrostatic capacity C between drain D of P channel MOSFET 7 and source S of N channel MOSFET 8. Effect of this electrostatic capacity C allows generation of difference of phase between input and output of CMOS amplifier 9. Delayed time of signals due to this difference of phase is hereinafter called as gate delayed time TG. Also, when electricity flows to the flat inductor 10, difference of phase occurs also at the both ends. Delayed time of signals due to this difference of phase is hereinafter called as delayed time of inductor TL.

Then, the total delayed time of signals (TG+TL) is generated between the input and output of the CMOS amplifier 9, out of which said delayed time TG is determined by its construction of the circuit if the amplifier is constructed and remains almost constant. On the other hand, the delayed time TL varies corresponding to the change of the distance x between the flat inductor 10 and the vibrated film 2 since the flat inductor 10 and the vibrated film 2 are connected electro-magnetically.

If this delayed time TL varies, then frequency and amplitude of the output signals of the oscillator change too. These changes correspond to the vibrated condition of the vibrated film 2. In order to increase detection sensitivity by setting these changes greater, it is enough only to increase specific electric conductivity. In order to increase the specific electric conductivity, it is preferable to use for the vibrated film 2 specific electric conductive materials, such as aluminum or gold.

Next, the frequency and amplitude of the output signals of the said oscillator 11 are measured to constitute sonic wave signals. Preferably, the frequency is measured by a pulse counter. Now, explanation is given referring to FIG. 5.

When the electro-magnetic wave is actually radiated from the flat inductor 10 of the said oscillator 11 to the said vibrated film, the output of the said oscillator 11 if received, becomes a pulse wave ranging from several tens MHz to several tens GHz, and waveform of which is in a pulse shape. The said processing logic 5 is equipped with a clock signal generator 12 with standard frequency of oscillating frequency of a crystal vibrator which generates a short period T1 clock and a long period T2 clock. Here, T1<<T2.

An output side of the said oscillator 11 is equipped with a short period pulse counter 13 and a long period pulse counter 14, said short period counter 13 counting number of pulses N1 in the short period T1, and said long period pulse counter 14 counting number of pulses N2 in the short period T2. An output side of the said short period pulse counter 13 and long period pulse counter 14 is equipped with a converter of difference of pulse number 15 which operates the difference of pulse number N=(N1×T2/T1)−N2.

Now, the said difference of pulse number is explained in more detail. FIG. 6 shows that the waveform of sonic wave is converted into the change of the oscillated frequency of the oscillator 11. In FIG. 6, horizontal axis T means time, vertical axis f means the oscillated frequency, and fO means the oscillated frequency of the oscillator 11 in case of no sonic wave. The oscillated frequency of the oscillator 11 varies from time to time upon receipt of sonic waves, and increases or decreases mainly around the frequency f0 in case of no sonic wave. Method to measure this oscillated frequency is that output signals from the oscillator 11 are gated in a sampling cycle of a short cycle T1 and long cycle T2, and number of pulses N1 in the short cycle T1 and number of pulses N2 in the long cycle are counted. Here, it is set as T2=1 sec at T1<<T2. N1/T1 in which the number of pulses N1 is divided by the short cycle T1 is equal to average frequency at the short cycle T1. N2/T2 in which the number of pulses N2 is divided by the long cycle T2 is equal to average frequency at the long cycle T2 which is enough longer than the frequency and to the frequency f0 in case of no sonic wave since the sonic wave vibrates several ten times or more per second. As apparent from the mentioned above, N1/T1 increases or decreases mainly around N2/T2. Therefore, displacement of the vibrated film by sonic wave is in a proportional relationship with N1/T1−N2/T2. Here, difference of number of pulses is defined as N1×T2/T1−N2. If output signals from the oscillator 11 are gated and number of pulses N1 and number of pulses N2 are counted by the short cycle pulse counter 13 and the long cycle pulse counter 14, (N1×T2/T1) varies per sampling from time to time around the number of pulses N2. Therefore, if number of pulses=(N1×T2/T1)−N2 is found, the difference of number of pulses expresses the waveform of the sonic wave.

Further, said converter of difference of pulse number 15 is a circuit to operate (N1×T2/T1)−N2. For example, given T1=$10^{-6}$ second and T1=1 second, it shows (N1×$10^{6}$)−N2, which is constituted by a subtraction circuit.

On an output side of the said converter of difference of pulse number 15, a functions adjustor 16 is equipped. On an output side of the said functions adjustor 16, a parallel-series converter 17, D/A converter 18, an integral circuit 19 and a parallel pulse output terminal 20 are equipped, said parallel-series converter 17 converting parallel pulse columns into analog signals, and said integration circuit integrating the output of the said D/A converter 18.

A clock pulse of the short period T1 generated by the said clock signal generator 12 corresponds to sampling frequency f1 which samples a waveform, and T1=1/f1. A clock pulse of the long period T2 is a long period of time enough in comparison with that of the short period T1, and usually it is set as 0.1 or several seconds or so.

Incidentally, in the difference of the number of pulses N, distortion due to non-linear characteristics of the x-f is included. Here, a representative example of the x-f characteristic is shown In FIG. 8. x is a distance between the vibrated film 2 and antenna 6. f is the frequency of the signals output by the oscillator 11, which corresponds to the N. This x-f characteristic is obtained from actually measured data. As shown in FIG. 8, if the vibrated film is displaced, the frequency f is changed mainly around the operation point according to the x-f characteristic. Since the x-f characteristic is non-linear, distortion occurs in the course of conversion of displacement of the vibrated film into change of the frequency. In order to adjust the distortion, the x-f characteristic is shown in a shape of a function which is converted into a linear function.

A shape of the function of the x-f characteristic is set as f=F(x), and the linear function as f=G(x)=ax+b. Here, a and b are constant number. In order to convert the x-f characteristic into the linear function, it is enough if a function H(x) which meets H(F(x))=G(x) is found. This function H(x) can be prepared by operation with the function adjustor 16 comprised of DSP or a logic circuit.

In FIG. 9, f=F(x) shown in a dotted line represents the actually measured x-f characteristic in a form of a function. f=G(x) shown in a solid line represents a line, and G(x) is the one for which F(x) is converted by H(x). Namely, f=G(x)=H(F(x)). In FIG. 5, the difference of number of pulses output from converter of difference of pulse number 15 of the processing logic 5 includes the distortion of the function f=F(x). In order to adjust the distortion, the difference of number of pulses can be converted by H(x) by the function adjustor 16.

Since the output of the said functions adjustor 16 becomes parallel digital data corresponding to the displacement of the vibrated film, output of the parallel-series converter 17 is used in order to output the same as series digital data. Also, when analog output is used, analog signals are obtained by the D/A converter 18 and the integrator 19.

As mentioned above, the frequency of the electromagnetic wave can be counted by a counter which is comprised of a conventional logic circuit. Therefore, it is possible to render the measurement circuit as a whole to an Integrated circuit, thereby a microphone can be offered, the structure of which being simple, light and at a low cost, and operating stably for a long period of time. Further, counting of the frequency enables to obtain the measured values in digital, thereby an optimum microphone can be offered which has good sensitivity or resolving power and is fit for whole digitalization.

Next, explained is the structure of the flat inductor which is used as both of an antenna and loop of the said device to receive and transmit electro-magnetic wave 4 (FIG. 1). There are two types of the structure of the flat inductor; a single flat inductor and push-pull flat inductor.

As shown in FIG. 10, the single type flat inductor 10 is formed by screen-printing of a circular spiral coil 10*b* on either surface of an insulating plate 10*a*.

Then, the said single type flat inductor is arranged close to either side of the vibrated film 2.

When this single type flat inductor 10 is used as an antenna, relationship of displacement x of the vibrated film 2 with frequency f of output signals of the said oscillator 11 includes non-linear ingredients, as shown in FIG. 8. In order to eliminate this non-linear relationship, it is preferable to employ the push-pull type flat inductor as shown in the following.

As shown in FIG. 11, in the push-pull type flat inductor, a first flat inductor 10A and a second flat inductor 10B are arranged close to both sides of the vibrated film 2, said first inductor 10A forming spiral coils 10*b* and 10*b*' along with a circumference of either surface of a pair of insulating plates 10*a*, 10*a*' in a ring shape.

Also, as shown in FIG. 12, the insulating plates 10*a* and 10*a*' in a ring shape are respectively equipped with holes 10*c* and 10*c*' for a wave path.

The said vibrated film 2 is supported and fixed at a central portion of a fixing frame 24 in a ring shape. The said first and second flat inductors 10A and 10B are fixed respectively at an upper or lower surface of the fixing frame 24 in a ring shape. That is, the vibrated film, the first flat inductor and the second flat inductor are arranged with equal distance.

In FIG. 11, when a sonic wave enters from the hole 10*c* of either insulating plate 10*a* to vibrate the vibrated film and the vibrated film is vibrated, the wave goes out from the hole 10*c*' of other insulating plate 10*a*'. In this type of the flat inductor, when the vibrated film vibrates, distance between the vibrated film 2 and the respective flat inductor is changed, and therefore signals of displacement of the vibrated film can be obtained from any of the flat inductors. If the signals thus obtained are synthesized by operation, a microphone with no distorted signals can be realized. Next, a method to synthesize two signals is explained.

Firstly, the method to output said two signals is explained.

As a construction of a circuit, a first oscillator is formed by an amplifier connected with the said first flat inductor, and a second oscillator is formed by an amplifier connected to the said flat inductor.

Similarly as described in FIG. 5, number of pulses output from the first oscillator and number of pulses output from the second oscillator are counted by the pulse counters of the first and second processing logics, which are formed respectively corresponding to the first and second oscillators. And, the first and second outputs are output from the pulse number difference converter formed respectively corresponding to the pulse counters of the first and second processing logics, which are formed respectively corresponding to the first and second oscillators. If the x-f characteristic of the two flat inductors is the same, the first and second outputs are as shown in FIG. 13.since the vibrated film, the first and second flat inductors are arranged with equal distance. As understood from FIG. 13, when the vibrated film is situated closer to the first flat inductor than the position in case of no sound, and if difference of pulses of the first output is Np1, and difference of pulses of the second is Np2, Np1>Np2 is resulted. When the vibrated film is situated closer the second flat inductor than the position in case of no sound, Np1<Np2 is resulted. Here, since much difference of number of pulses brings higher sensitivity, the first output and second output are switched to be the total output. Namely, as shown in FIG. 14, when the vibrated film is situated closer to the first flat inductor than the position in case of no sound, the difference of number of pulses Np1 which is the first output is used, while the difference of number of pulses Np2 which is the second output is used, when the vibrated film is situated closer to the second flat inductor than the position in case of no sound. That is, a solid line portion in FIG. 14 becomes a total output. In this manner, a linear output can be obtained comparing with the case of a single inductor. Instead of switching, the output of the converter of the difference of pulse number corresponding to the outputs of the first and second outputs can be simply added and averaged to form the total output.

If the first and second outputs are simply added and averaged, characteristics of the total output are as shown in FIG. 15. Also in this case, the overall characteristics become nearly linear.

In addition to the circular spiral structure of the flat inductor, the same effect can be obtained if a multi-angular spiral structure is employed.

As mentioned above, the structure and constituent factors of the microphone of the present invention are described. The microphone of the present invention provides a microphone which can be used in wider range of fields, such as for mobile phones, karaoke, and hearing-aids.

Effects of the Invention

The microphone according to the present invention can count the number of pulses by the counter comprising of a conventional logic circuit since the electro-magnetic wave with frequency less than $10^{12}$ Hz is employed in place of a laser beam. And the change of the measured frequency of the electro-magnetic wave can be used as output signals. Therefore, the measurement device as a whole can be formed as an integrated circuit, which provides a microphone weighing light and operating stably for a long period of time.

Figure 1:
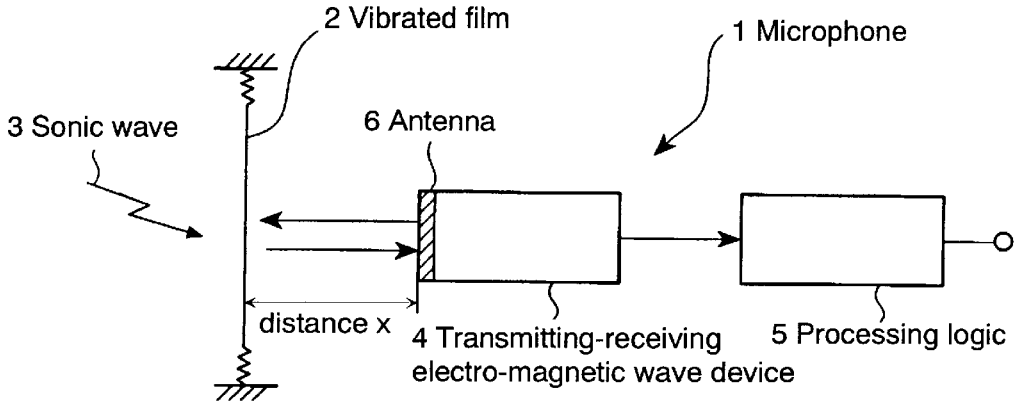
FIG. 1 is a block diagram showing basic structure of the present invention.
Figure 2:
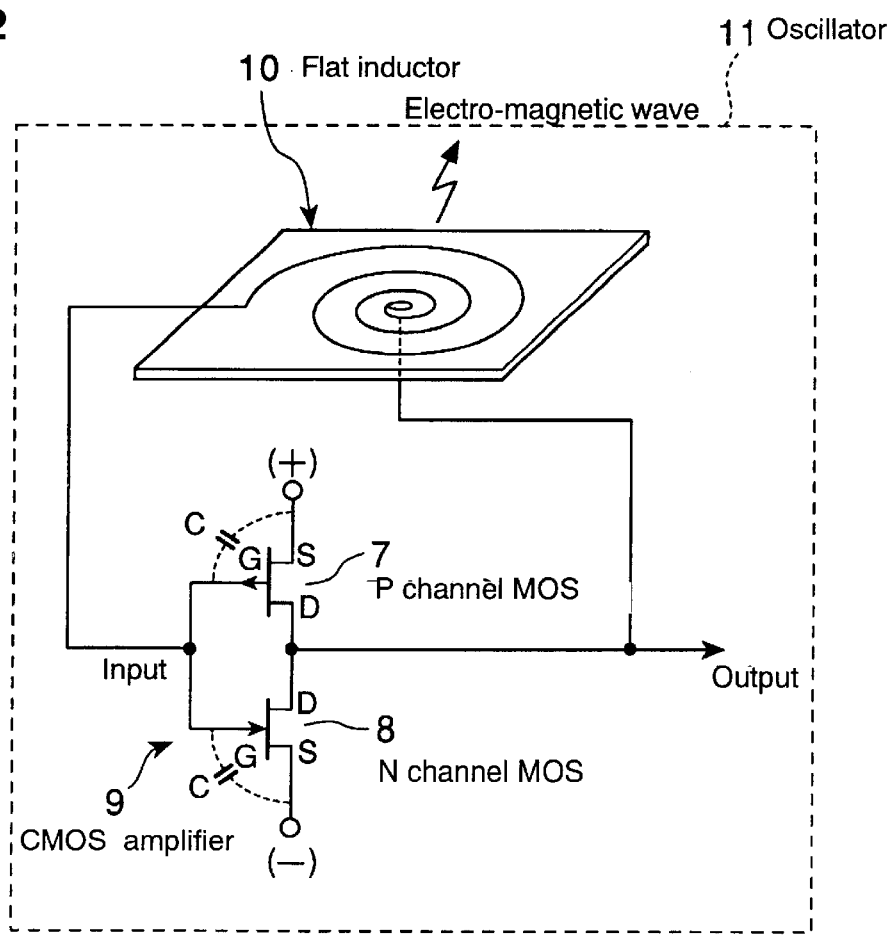
FIG. 2 is a circuit diagram of the oscillator used in the present invention.
Figure 3:
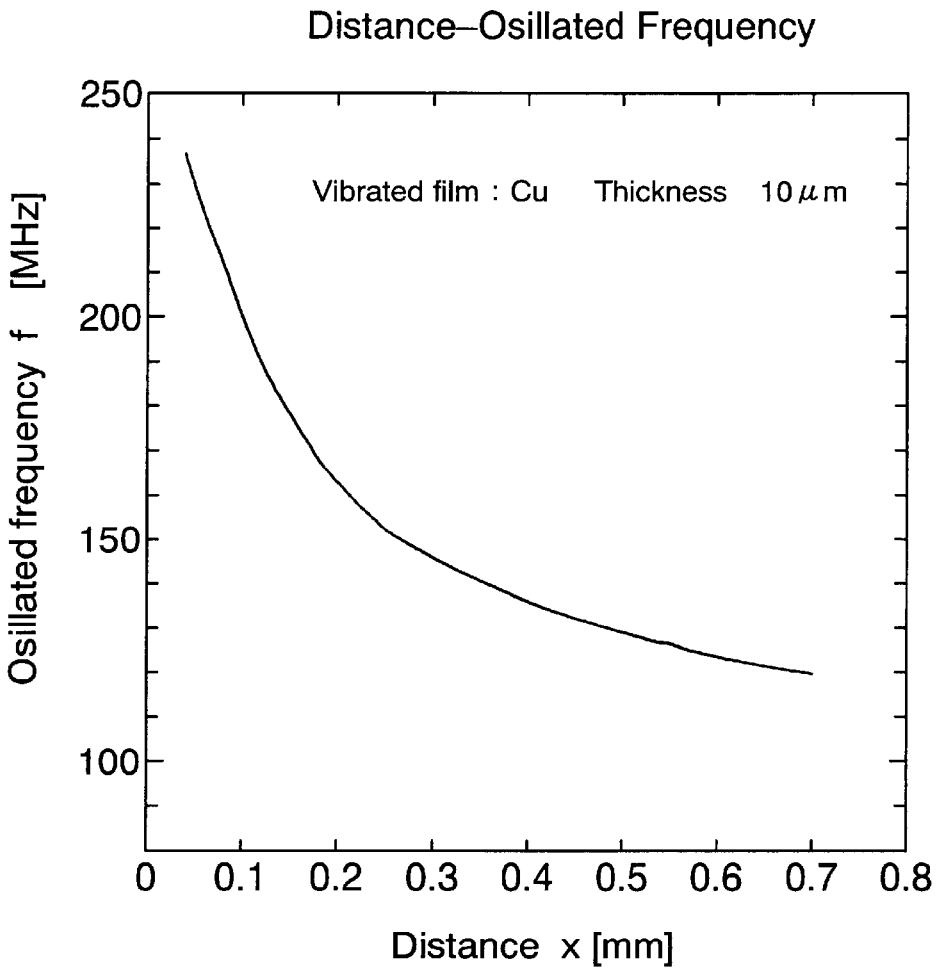
FIG. 3 is a graph of characteristics showing the relationship of a distance between vibrated film and an antenna with oscillated frequency.
Figure 4:
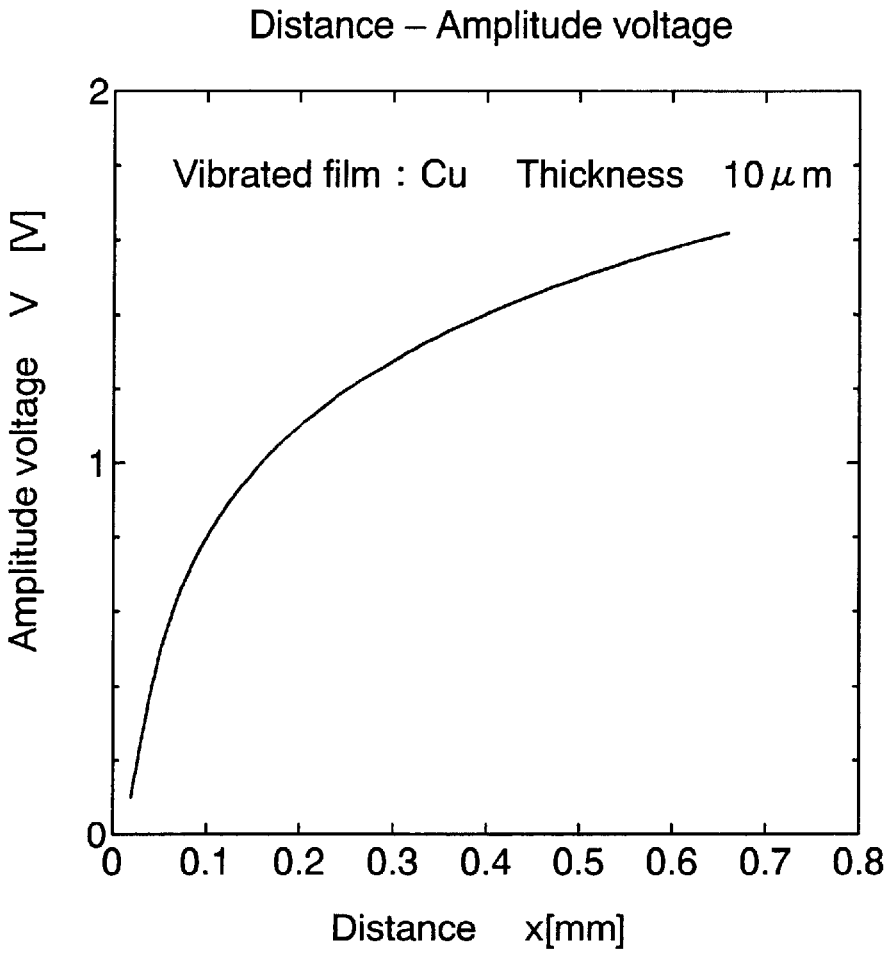
FIG. 4 is a graph of characteristics showing the relationship of a distance between vibrated film and an antenna with amplitude voltage.
Figure 5:
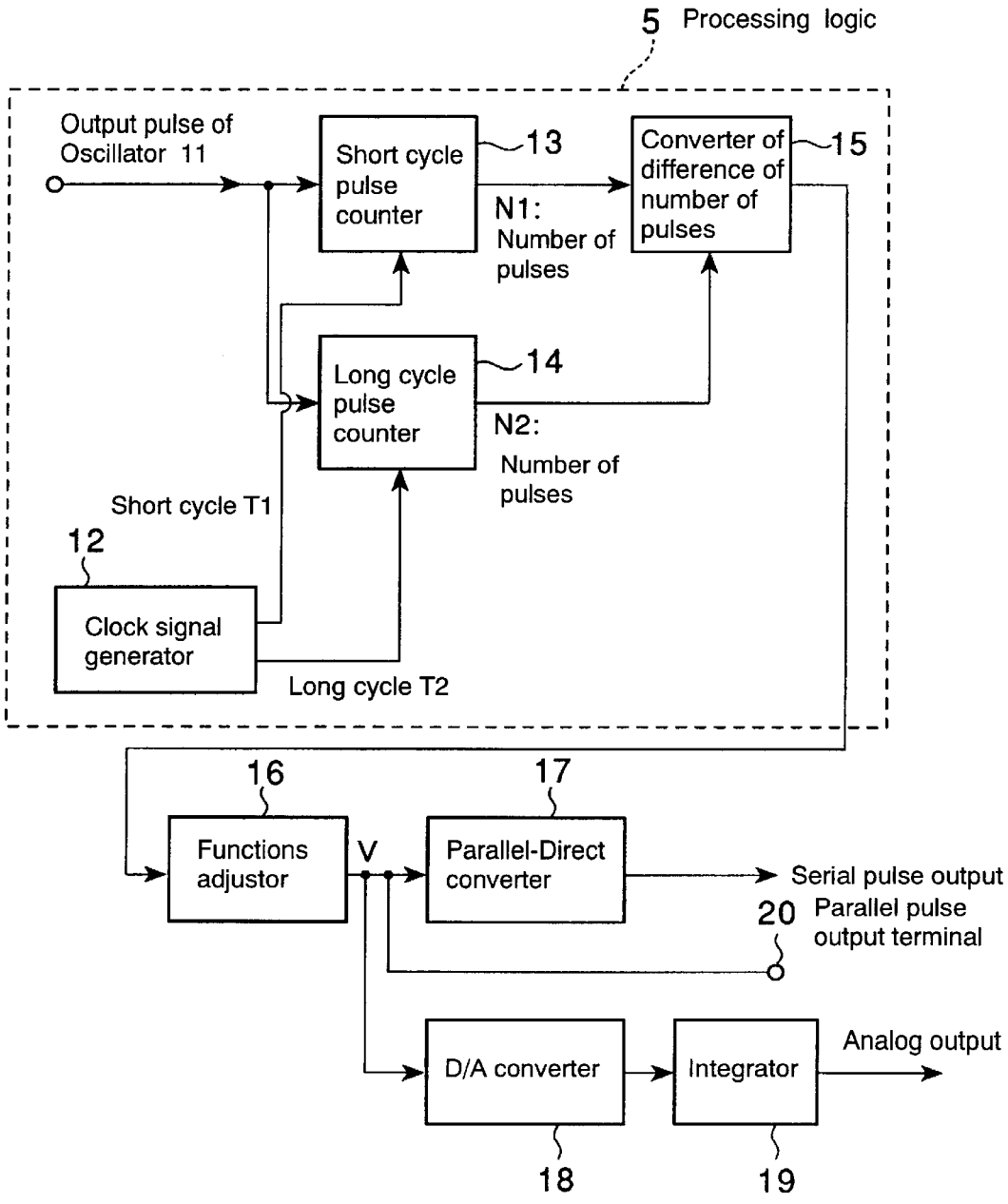
FIG. 5 is a block circuit diagram of the processing logic.
Figure 6:
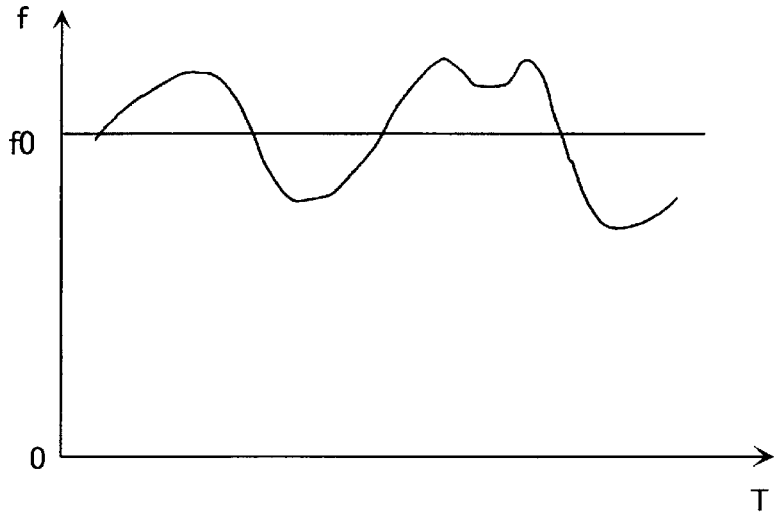
FIG. 6 is a graph of signals of oscillated frequency output by a device to receive and transmit electro-magnetic wave when a vibrated film receives a sonic wave.
Figure 7:
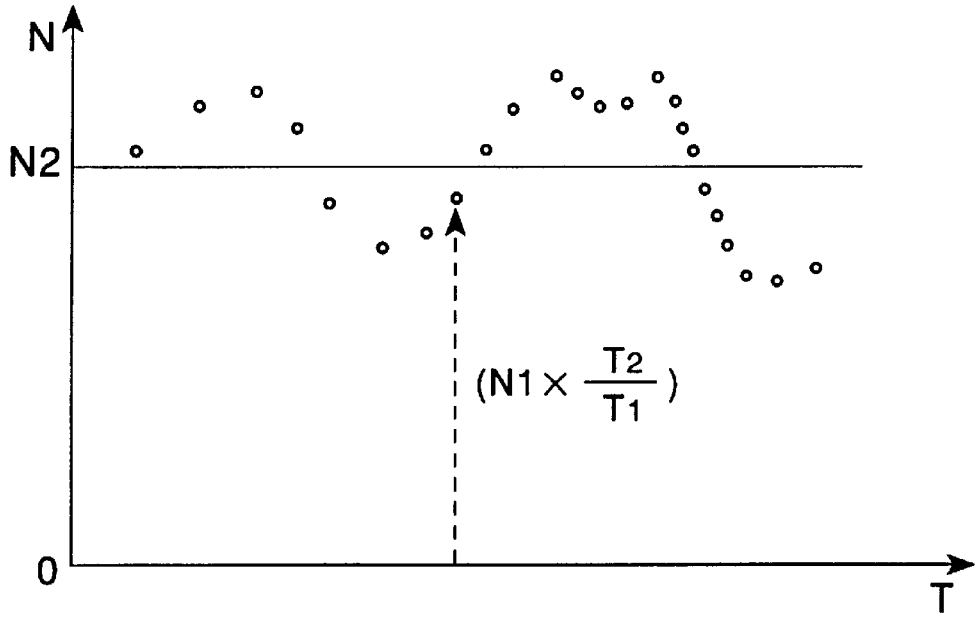
FIG. 7 is a graph of signals showing difference of number of output by a processing logic upon receipt of a sonic wave by the vibrated film.
Figure 8:
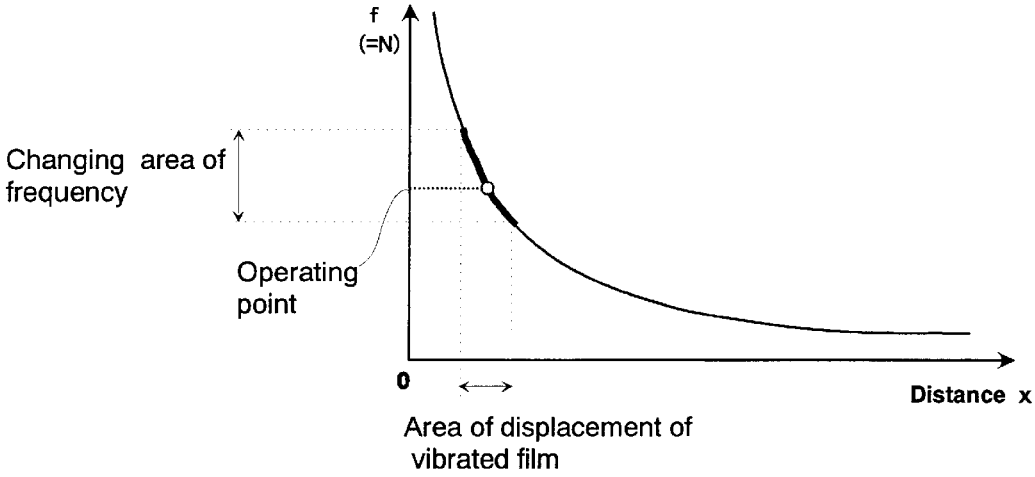
FIG. 8 is a graph of characteristics showing the relationship of displacement of the vibrated film with oscillated frequency.
Figure 9:
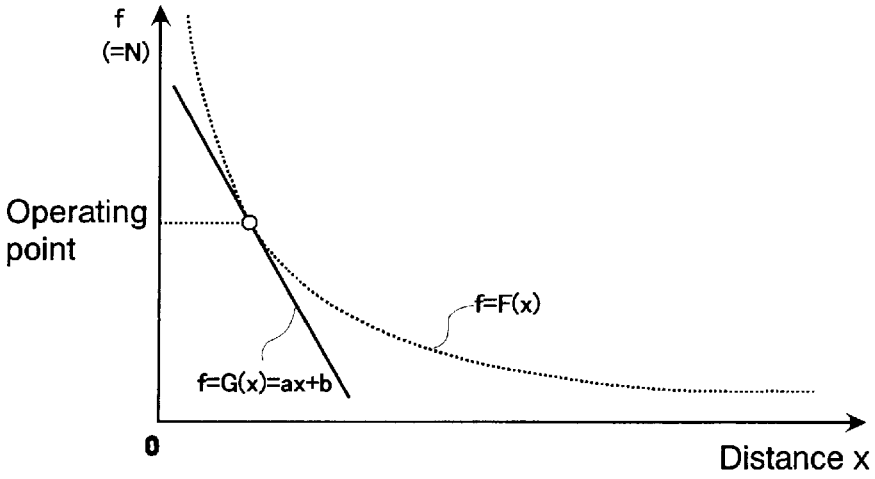
FIG. 9 is a function to eliminate distortion.
Figure 10:
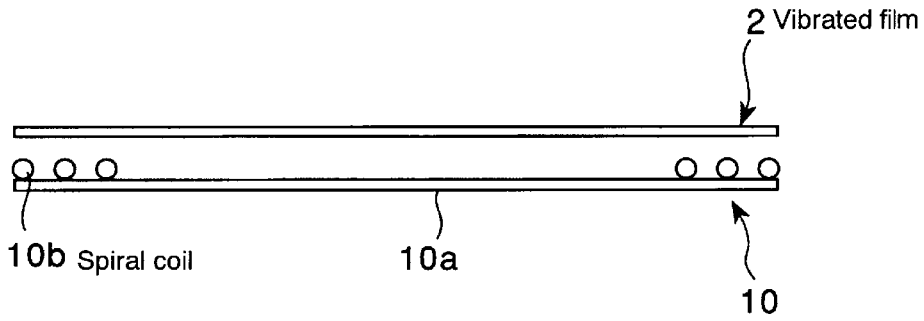
FIG. 10 is a drawing showing an example of arrangement of the flat inductor and vibrated film used In the present invention.
Figure 11:
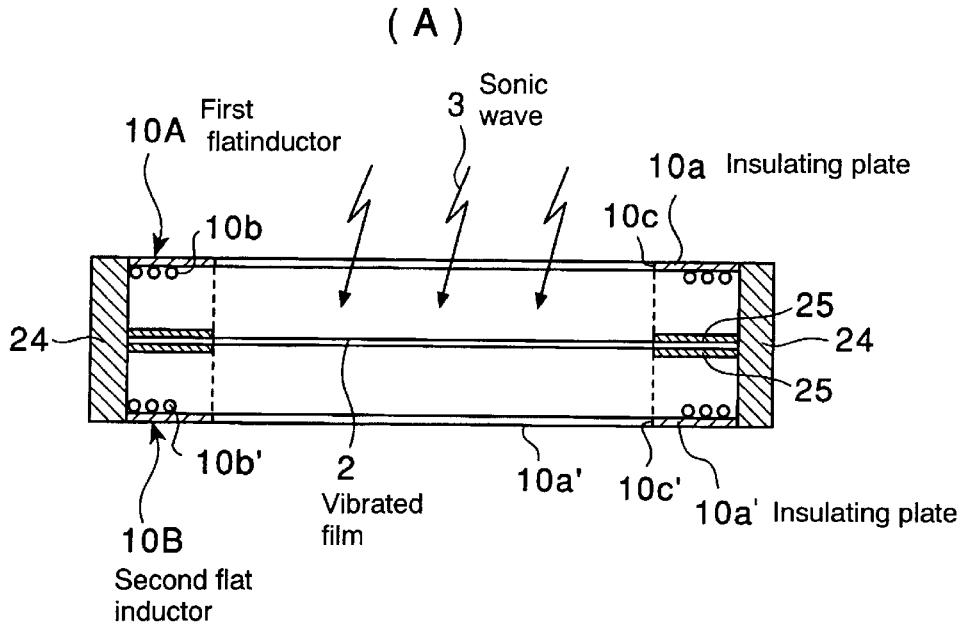
FIG. 11 is a drawing showing another example of arrangement of the flat inductor and vibrated film used in the present invention.
Figure 12:
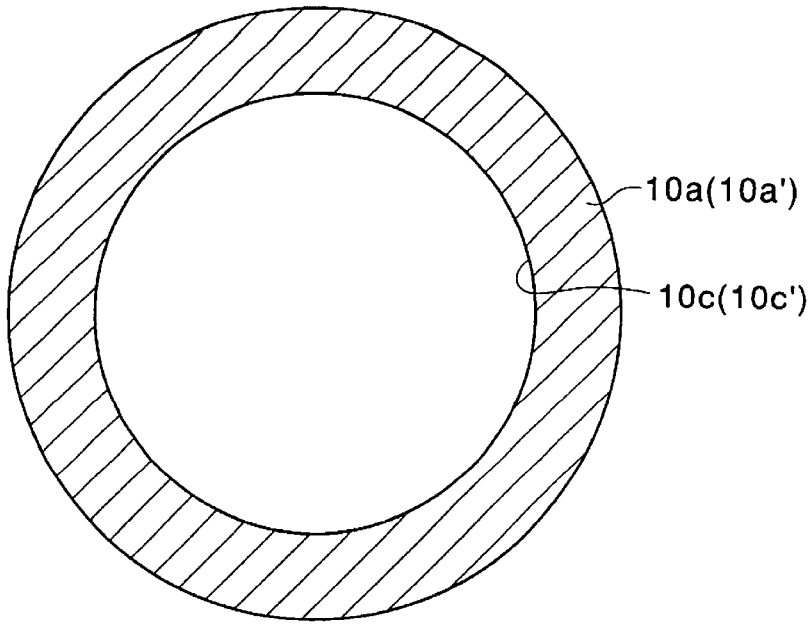
FIG. 12 is a drawing showing an insulating plate to fix the flat inductor used in the present invention.
Figure 13:
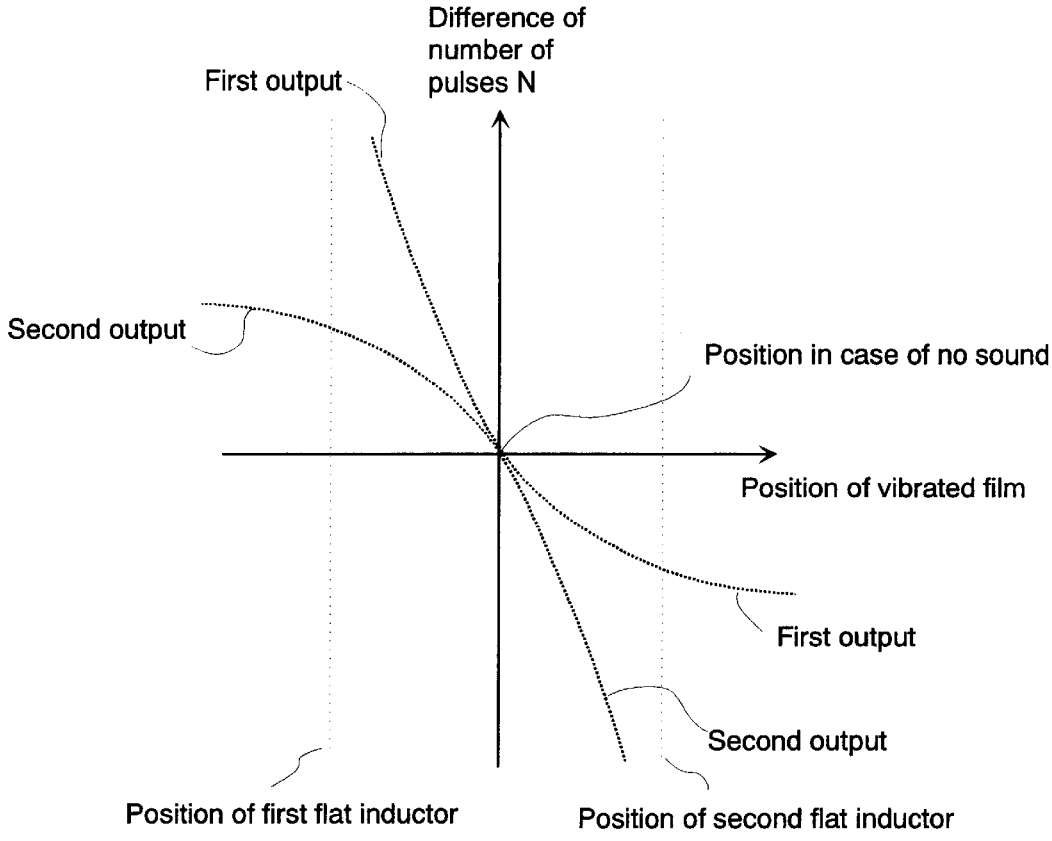
FIG. 13 is a graph showing the first and second outputs.
Figure 14:
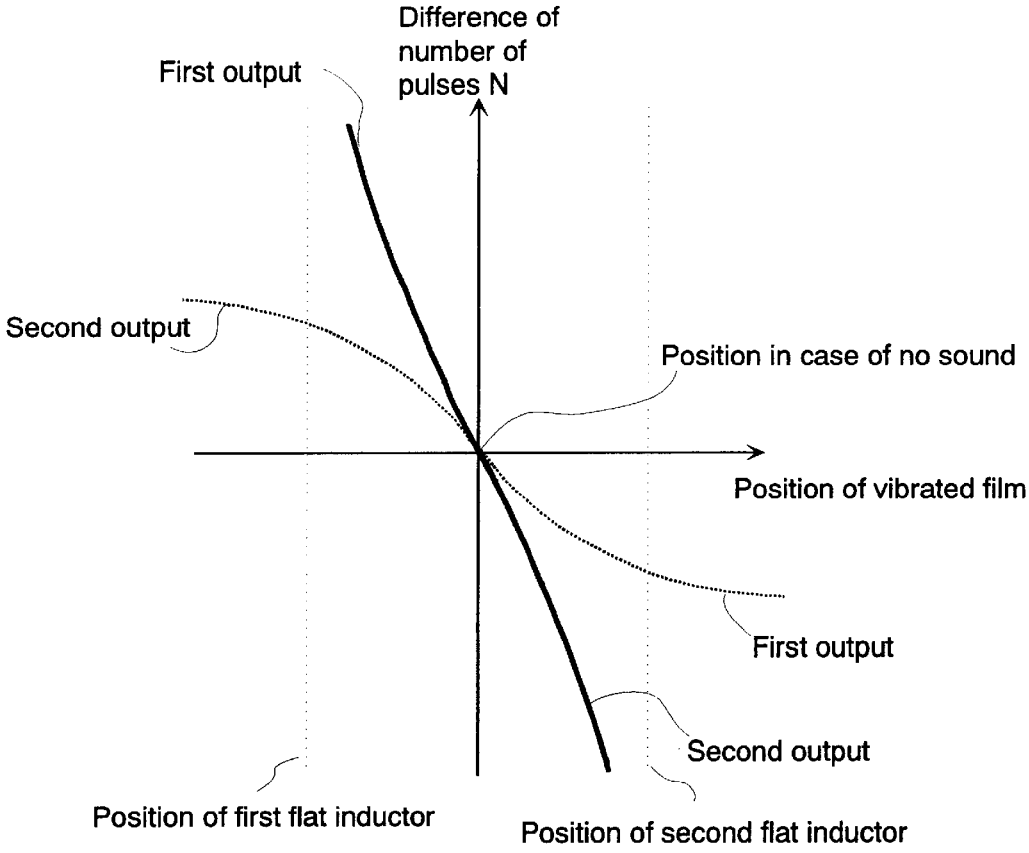
FIG. 14 is a graph showing an example of the overall characteristics according to the present invention.
Figure 15:
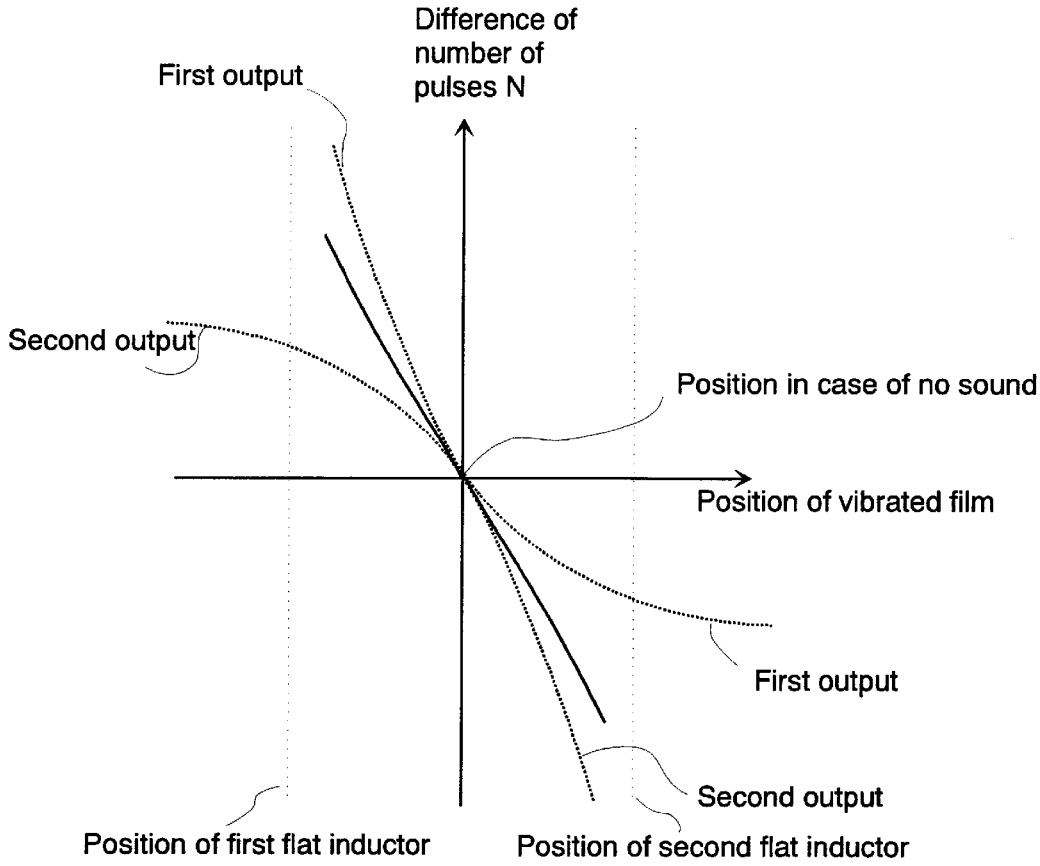
FIG. 15 is a graph showing another example of the overall characteristics according to the present invention.

| [Explanation of References] | |
|---|---|
| 1 . . . microphone | 2 . . . vibrated film |
| 4 . . . device to receive and transmit electro-magnetic wave | |
| 5 . . . processing logic | |

-continued

| [Explanation of References] |
|---|
| 10 . . . flat inductor |
| 11 . . . oscillator |
| 12 . . . clock signal generator |

What is claimed is:

1. An electro-magnetic microphone comprising:

a vibrated film receiving sonic waves on one surface and electro-magnetic waves on the other surface;

a transmitting-receiving device outputting and receiving the electro-magnetic waves to and from the vibrated film;

a counter counting pulses output from the transmitting-receiving device; and processing logic receiving the output from the counter, wherein frequencies of the electro-magnetic waves are less than $10^{12}$ Hz, and wherein said transmitting-receiving device comprises:

a flat inductor forming a feedback loop functioning as an antenna and as an oscillator to radiate and receive said electro-magnetic waves to and from said vibrated film; and an oscillator in which the said flat inductor is connected to the feedback loop.

2. A microphone according to claim 1 wherein the vibrated film is comprised of a conductive material with resistance ratio less than $20\times10^{-6}\{\Omega\ \text{cm}\}$ at 0° C.

3. A microphone according to claim 1 wherein the vibrated film is comprised of a conductive material adhered to an insulating membrane, the conductive material being with resistance ratio less than $20\times10^{-6}\{\Omega\ \text{cm}\}$ at 0° C.

4. A microphone according to claim 1 wherein the vibrated film is formed of an aluminum membrane or gold membrane.

5. A microphone according to claim 1 wherein the flat inductor is arranged close to either surface of the vibrated film.

6. An electro-magnetic microphone comprising:

a vibrated film receiving sonic waves on one surface and electro-magnetic waves on the both surfaces;

a transmitting-receiving device outputting and receiving the electro-magnetic waves to and from the vibrated film;

a counter counting pulses output from the transmitting-receiving device; and processing logic receiving the output from the counter, wherein frequencies of the electro-magnetic waves are less than $10^{12}$ Hz, and wherein said transmitting-receiving device comprises:

a first flat inductor and a second flat inductor forming a feedback loop functioning as an antenna and as an oscillator to radiate and receive said electro-magnetic waves to and from said vibrated film; and a first oscillator and a second oscillator in which the said flat inductor and the second flat inductor are connected to the feedback loop.

7. A microphone according to claim 6 wherein the vibrated film is comprised of a conductive material with resistance ratio less than $20\times10^{-6}\{\Omega\ \text{cm}\}$ at 0° C.

8. A microphone according to claim 6 wherein the vibrated film is comprised of a conductive material adhered to an insulating film, said conductive material being with resistance ratio less than $20\times10^{-6}\{\Omega\ \text{cm}\}$ at 0° C.

9. A microphone according to claim 6 wherein said vibrated film is formed of an aluminum membrane or gold.

10. A microphone according to claim 6 wherein the first flat inductor is arranged close to either surface of said vibrated films, and wherein said second flat inductor is arranged close to the other surface of the vibrated film, respectively.

* * * * *